US005296121A

United States Patent [19]

Beaver, deceased et al.

[11] Patent Number: 5,296,121

[45] Date of Patent: Mar. 22, 1994

[54] TARGET ELECTRODE FOR PREVENTING CORROSION IN ELECTROCHEMICAL CELLS

[75] Inventors: Richard N. Beaver, deceased, late of Angleton, Tex., by Wanda Beaver, executor; Gordon E. Newman, Sugarland, Tex.

[73] Assignee: The Dow Chemical Company, Midland, Mich.

[21] Appl. No.: 935,626

[22] Filed: Aug. 24, 1992

[51] Int. Cl.[5] ..... C25B 9/00; C25B 11/10; C25B 15/08

[52] U.S. Cl. ..... 204/228; 204/255; 204/269; 204/290 R; 204/290 F; 204/275; 204/268; 204/263; 204/257

[58] Field of Search ..... 204/228, 255-256, 204/257-258, 263-266, 268-270, 275, 279, 290 F, 290 R

[56] References Cited

U.S. PATENT DOCUMENTS

| | | | |
|---|---|---|---|
| 3,909,368 | 9/1975 | Raymond et al. | 204/228 X |
| 3,972,796 | 8/1976 | Fröhler et al. | 204/279 X |
| 4,197,169 | 4/1980 | Zahn et al. | 204/228 X |
| 4,312,735 | 1/1982 | Grimes et al. | 204/228 |
| 4,371,433 | 2/1983 | Balko et al. | 204/228 |
| 4,377,445 | 3/1983 | Grimes | 204/228 X |
| 4,382,849 | 5/1983 | Spicer | 204/258 |

*Primary Examiner*—Donald R. Valentine

[57] ABSTRACT

In an electrolyzer system having metallic supply and discharge piping subjected to shunt currents, the improvement which comprises a removable target electrode in the section of said piping subjected to said shunt currents, said target electrode having a lower overvoltage than the metallic piping being protected.

19 Claims, 3 Drawing Sheets

TARGET ELECTRODE FOR PREVENTING CORROSION IN ELECTROCHEMICAL CELLS

FIELD OF THE INVENTION

The present invention relates to a novel target electrode for use in preventing corrosion in electrochemical cells. More particularly, the invention is concerned with the prevention of corrosion in electrochemical cells at junctures of electrically conducting pipes to non-electrically conducting pipes as a result of shunt currents.

BACKGROUND OF THE INVENTION

There are three types of electrolytic cells primarily used for the commercial production of halogen gas and aqueous alkali metal hydroxide solutions from alkali metal halide brines, a process referred to by industry as a chlor-alkali process. Two of these cells are the diaphragm cell and the membrane cell. The general operation of each cell is known to those skilled in the art and is discussed in Volume 1 of the Third Edition of the *Kirk-Othmer Encyclopedia of Chemical Technology* at page 799 et. seq., the relevant teachings of which are incorporated herein by reference.

In the diaphragm cell, an alkali metal halide brine solution is continually fed into a anolyte compartment containing an anolyte solution where halide ions are oxidized at the anode to produce halogen gas. The anolyte solution, including alkali metal cations contained therein, migrates to a catholyte compartment containing a catholyte solution through a hydraulically-permeable microporous diaphragm disposed between the anolyte compartment and the catholyte compartment. Hydrogen gas and an aqueous alkali metal hydroxide solution are produced at the cathode. Due to the hydraulically permeable nature of the diaphragm, the anolyte solution mixes with the alkali metal hydroxide solution formed in the catholyte compartment.

The membrane cell functions similarly to the diaphragm cell, except that the diaphragm is replaced by a hydraulically-impermeable, cationically-permselective membrane which selectively permits passage of alkali metal ions to the catholyte compartment. The membrane essentially prevents hydraulic permeation of the anolyte solution to the catholyte compartment, except for the alkali metal cations. Therefore, a membrane cell produces alkali metal hydroxide solutions relatively uncontaminated with the alkali metal halide brine.

Membrane cells are typically assembled in "stacks" comprising a plurality of bipolar plate electrodes, the electrodes being assembled in a filter press arrangement wherein each electrode is positioned in a spaced-apart but face-to-face planar relationship with respect to an adjacent electrode. A membrane is positioned between each adjacent bipolar electrode, thereby forming a series of alternating catholyte and anolyte compartments. A stack may also comprise a plurality of membrane cells having monopolar electrodes where the cells are electrically connected in series with respect to each other. Membrane cell stacks generally have common electrolyte and product piping. Membrane cell stacks are known in the chlor-alkali industry and, for example, are described in Volume 6A of *Ullman's Encyclopedia of Industrial Chemistry* (5th Ed. 1986) at pages 399 et. seq., the relevant teachings of which are incorporated herein by reference.

It is well known that shunt currents exist in stacks of bipolar plate cells with common electrolytes. These shunt currents are undesirable for at least two reasons: they can cause corrosion of some of the components of the system, and they are currents that are essentially lost in terms of the production of the desired products of the system. The corrosion problem can be particularly severe if the shunt currents leave the cells via conducting nozzles to which they are attached the inlet and outlet tubes for the cells. It is desirable, therefore, to be able to reduce the effect of the shunt currents for all of the inlet and outlet tubes for cells in stacks.

The piping carrying the anolyte or brine to the stack of the cells is normally a titanium containing metal which is connected to the stack by a non-conductive tubing. During normal electrolysis, shunt currents pass from the individual cells at the positive end of the stack and enter the tubes. When the tubes are made of a poor electrical conductor, the current flow that passes in the tubes is conducted by ions. This current is also called the bypass current. The current operates by a cathodic electrolysis reaction such as:

$$2H_2O+2e^- \rightarrow H_2+2OH^- E^\circ=-0.2V \quad (1)$$

At the negative end, the current leaves the piping by an anodic electrolysis reaction, such as:

$$2Cl^- \rightarrow Cl_2+2e^- E^\circ=+1.3V \quad (2)$$

The current then flows from the housing at the positive end into the non-conductive tubes and returns to the cells at the negative of the cell stacks. The current flow in the non-conductive tubes is again conducted by ions and in order for the current to enter the metal structure at the negative end of the cell stack, a reduction reaction such as reaction (1) must again occur.

Because of these shunt currents, titanium may be dissolved by an anodic reaction such as:

$$Ti+4Cl^- \rightarrow TiCl_4+4e^- E^\circ=+0.4 \quad (3)$$

Merely grounding the titanium piping as proposed by the prior art does not solve the problem of protecting the titanium against corrosion as a result of the shunt currents since they still exist and corrosion can still occur at those points where the current flows. $TiH+$ forms as a result of penetration of atomic hydrogen into titanium and typically occurs as a result of an electrolysis reaction. $TiH+$ is known to cause embrittlement of titanium.

An important member of an electrolyzer system to be protected is the titanium nozzle which is connected to the anolyte compartment at one end and is connected to the polymeric or Teflon tubing leading to the titanium piping at the other end. Shunt currents pass through this nozzle which is located at the negative end of the cell stack. To prevent a reduction reaction that produces hydrogen and creates $TiH_2$, corrosion protection should be provided. Since the nozzle is a piping member that must contain $Cl_2$ and anolyte under pressure, its protection against $TiH_2$ stress crack failure is important.

SUMMARY OF THE INVENTION

According to the invention there is provided an electrolyzer system, particularly a bipolar electrolytic cell, comprising a plurality of unit cells electrically aligned in series with each unit cell being divided into an anode chamber and a cathode chamber by an ion exchange membrane or diaphragm. Each of the anode and cathode chambers have a metallic supply pipe and a discharge pipe which are respectively connected at each end to common headers through an inert non-conductive polymeric tube or pipe. At or about the junction of the polymeric tube or pipe with the header and the supply pipe and/or discharge pipe, that is, the section subjected to shunt currents, there is provided a removable target electrode having a lower overvoltage than the metallic piping being protected.

The target electrode can take any form provided a passage of fluid still occurs within the piping in which it is used. Advantageously a resilient sleeve is used which is frictionally held in place and is a component separate from the piping.

The target electrode can be an electrically conductive plastic or plastic with electrically conductive particles, metallic, ceramic or a ceramic coated metal.

Preferably, the metal is iron, steel, nickel or a valve metal. Titanium or tantalum are preferred since they are found in most piping used with electrolyzers.

In a chlor alkali system, the target electrode is preferably a removable member consisting of a metal substrate having a platinum group metal oxide coating. Advantageously, the metal is iron, nickel, stainless steel, a valve metal or alloys thereof. Most preferable, when the piping in the system is titanium, titanium or tantalum are utilized with a ceramic coating, particularly a platinum group metal oxide coating.

Other features and advantages of the invention will become apparent from the following description, taken with the accompanying drawings.

DESCRIPTION OF THE PREFERRED EMBODIMENTS

Figure 1:
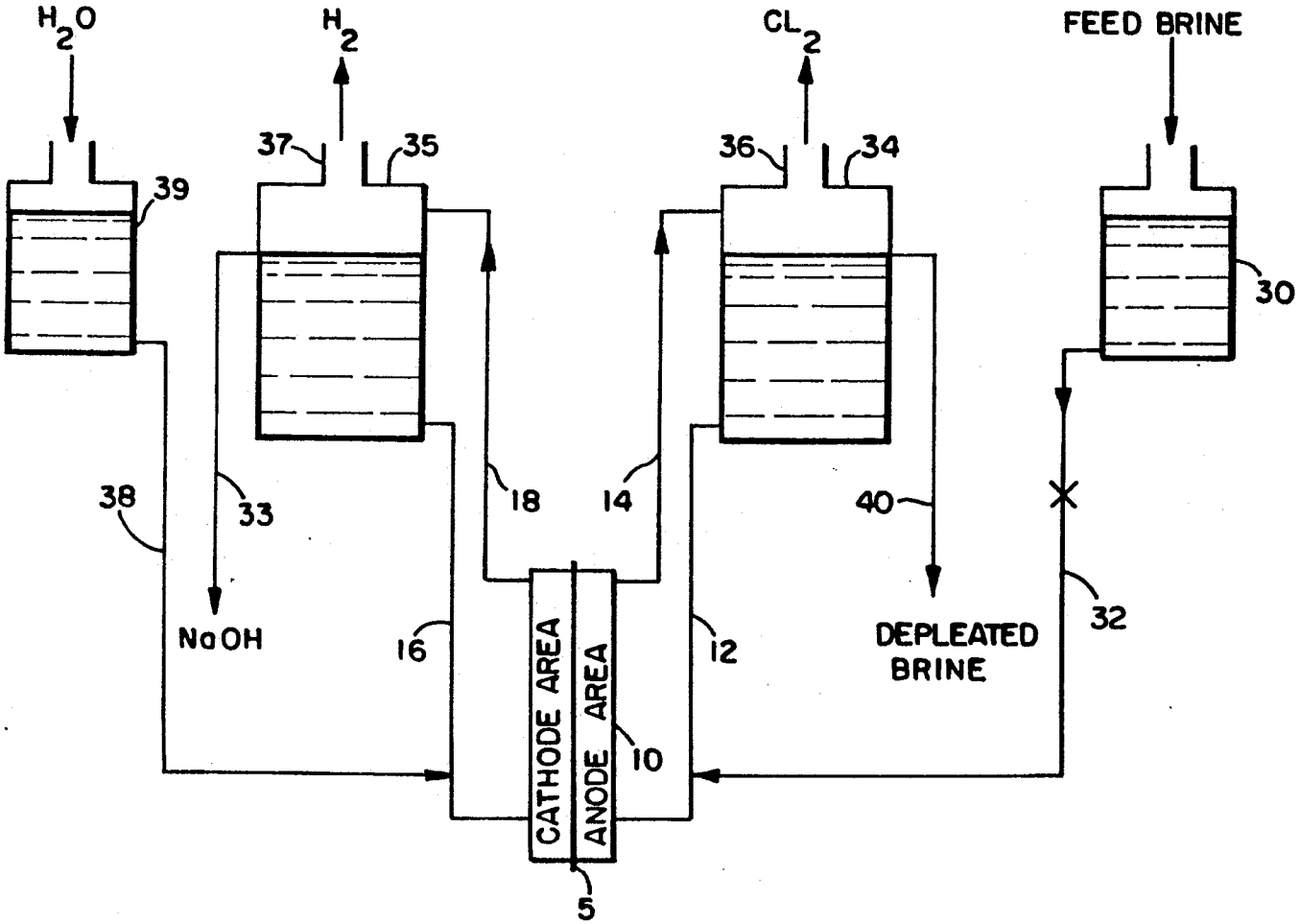
FIG. 1 is a diagrammatical view showing the concept of a filter press type bipolar electrolytic cell.

FIG. 1 diagrammatically illustrates the manner of operating the cell herein contemplated. As shown therein, a cell 10 is provided with anolyte inlet line 12 which enters the bottom of the anolyte chamber (anode area) of the cell and leaves by anolyte exit line 14 which exits from the top of the anode area. Similarly, catholyte inlet line 16 discharges into the bottom of the catholyte chamber of cell 10 and the cathode area has an exit line 18 located at the top of the cathode area. The anode area is separated from the cathode area by membrane 5 having anode pressed on the anode side and cathode pressed on the cathode side.

The anode chamber or area is bounded by the membrane and anode on one side and the anode end wall on the other, while the cathode area is bounded by the membrane and the cathode on one side and the upright cathode end wall on the other. In the operation of the system, the aqueous brine is fed from a feed tank 30 into line 12 through a valved line 32 which runs from tank 30 to line 12 and a recirculation tank 34 is provided and discharges brine from a lower part thereof. The brine concentration of the solution entering the bottom of the anode area is controlled to be at least close to saturation by proportioning the relative flows through line 32 and the brine entering the bottom of the anode area flows upward and in contact with the anode. Consequently, chlorine is evolved and rises with the anolyte and both are discharged through line 24 to tank 34 where the chlorine is separated and escapes as indicated through exit port 36. The brine is collected in tank 34 and is recycled and some portion of this brine is withdrawn as depleted brine through overflow line 40 and sent to a source of solid alkali metal halide for resaturation and purification.

On the cathode side, water is fed to line 16 from a tank or other source 39 through line 38 which discharges into recirculating line 16 where it is mixed with recirculating alkali metal hydroxide (NaOH) coming through line 16 from the recirculation tank. the water alkali metal hydroxide mixture enters the bottom of the cathode area and rises toward the top thereof through a compressed gas, permeable mat or current collector. During the flow, it contacts the cathode and hydrogen gas as well as alkali metal hydroxide are formed. The cathode liquor is discharged through line 18 into tank 35 where hydrogen is separated through port 39 and alkali metal hydroxide solution is withdrawn through line 39. Water fed through line 38 is controlled to hold the concentration of NaOH or other alkali at the desired level. This concentration may be as low as 5 or 10% alkali metal hydroxide by weight but normally, this concentration is above about 15%, preferably in the range of 15 to 40 percent by weight.

Since gas is evolved at both electrodes, it is possible and indeed advantageous to take advantage of the gas lift properties of evolved gases which is accomplished by running the cell in a flooded condition and holding the anode and cathode electrolyte chambers relatively narrow, for example, 0.5 to 8 centimeters in width. Under such circumstances, evolved gas rapidly rises carrying the electrolyte therewith and slugs of electrolyte and gas are discharged through the discharge pipes into the recirculating tanks. This circulation may be supplemented by pumps, if desired.

Figure 2:
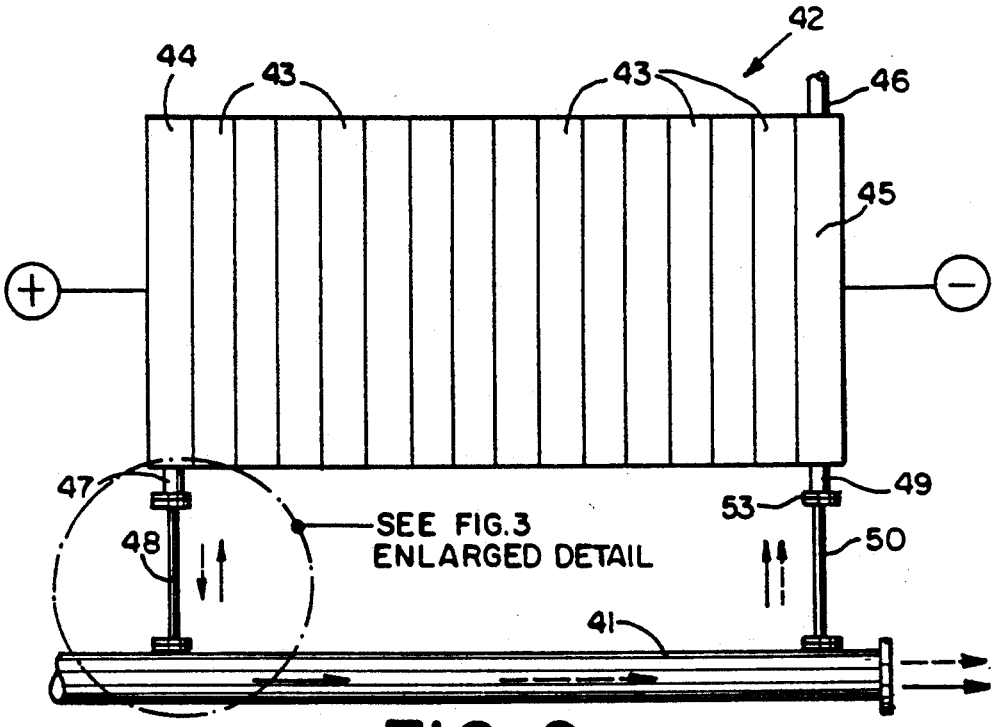
FIG. 2 illustrates a unit cell and headers with the connection by a non-conductive polymeric pipe.

As shown in FIG. 2, a bipolar electrolyzer 42 is provided with a header 41 for supplying an aqueous solution of an alkali metal chloride. The electrolyzer 42 has a plurality of individual cells 43 electrically and mechanically in series with an anodic cell 44 at one end of the electrolyzer 42 and a cathodic cell 45 at the opposite end of the electrolyzer 42.

The solution enters the first cell 43 through the terminal anode cell 44 and leaves the terminal cathode cell 45 by outlet 46. The solution enters the terminal anode cell 44 through nozzle 47 which is connected to a header 41, which is preferably titanium, by means of a non-conductive tubing 48.

At the terminal cathode cell 45 there is provided a nozzle 49 which is connected to the header 41 through a non-conductive tubing 50.

Figure 3:
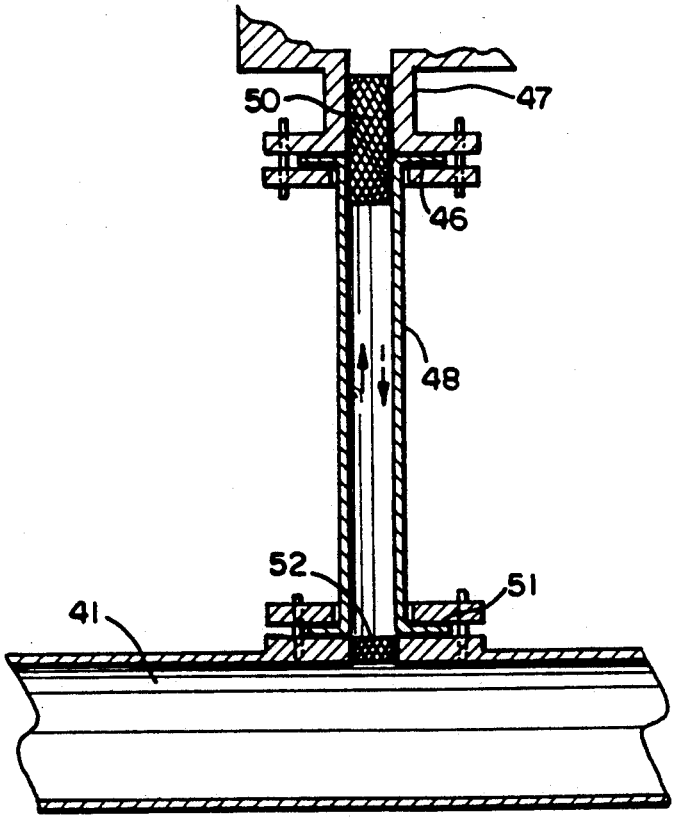
FIG. 3 shows the juncture in the system of FIG. 2 with the target electrode of the invention.

As shown in FIG. 3, at the junction 46 of the nozzle 47 with the non-conductive tubing 48 there is provided a target electrode 50. Similarly at or about the junction 51 of the header 41 there is provided a target electrode 52. There can also be provided target electrodes at the junction 53, 54 of the non-conductive tubing 50.

At least the inside surface of the portion of each tubing 48 and 50 should be made of an electrically non-conductive material, preferably a pipe made of a non-conductive material, or a pipe (e.g., a metallic pipe) whose inside wall is coated with an electrically non-conductive material. In other words, the liquid within the tubing 48 and 50 should be electrically insulated from the liquid in the unit cell and the wall of the unit cell. The non-conductive material preferably should be resistant to deterioration by liquids and gases within the unit cell. Specific examples of the non-conductive material include fluorine containing resins such as polytetrafluoroethylene, tetrafluoroethylene/perfluoroalkyoxyethylene copolymers, a tetrafluoroethylene/hexafluoropropylene copolymer, tetrafluoroethylene/ethylene copolymer, polytrifluorochloroethylene and polyvinylidene fluoride, polyolefins such as polypropylene and polyethylene, and polyvinyl chloride resins.

Figure 4A:
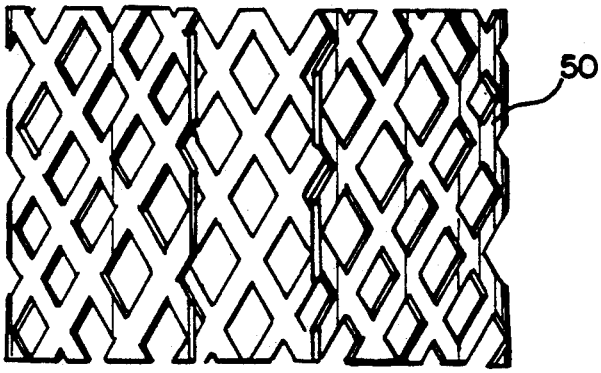
FIG. 4*a* is a side view of a split sleeve tubular target electrode of the invention.
Figure 4B:
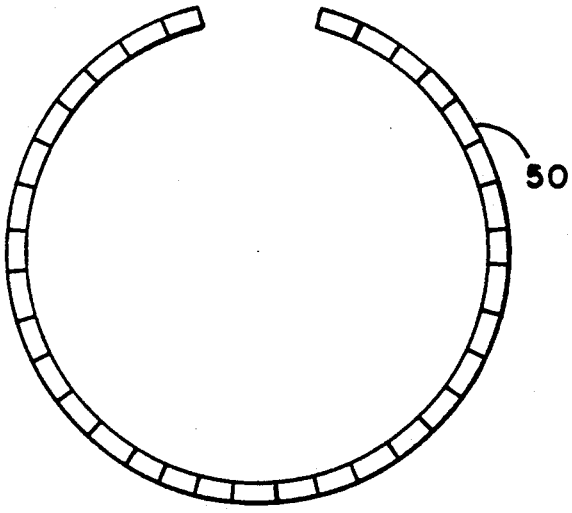
FIG. 4*b* is a top view of the target electrode of FIG. 4*a*.

The target electrode can be in any form provided a passage of fluid is maintained. As seen in FIGS. 4*a* and 4*b*, one form of the target electrode is a removable split sleeve which can be inserted into the junction and expanded so as to fit snugly in the junction without the need of any fastening means. Advantageously, the target electrode can be easily removed or replaced after it has been corroded.

Figure 5A:
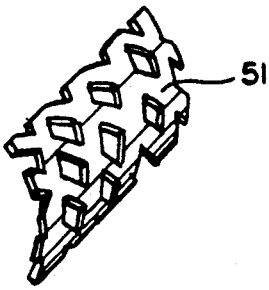
FIG. 5*a* shows a target electrode in the form of a half-sleeve insert.

FIG. 5*a* shows a target electrode 51 in the form of a half-sleeve.

Figure 5B:
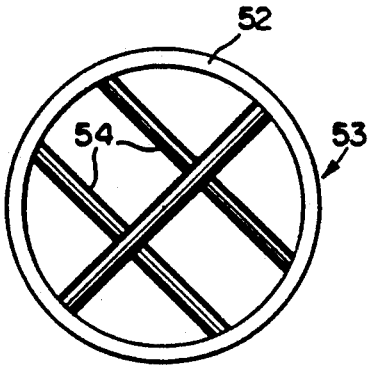
FIG. 5*b* shows a target insert in the form of a flow through mesh.

FIG. 5*b* illustrates a target electrode 52 comprising a ceramic portion 53 and a metallic screen 54.

The target electrode for use in a chlor alkali system is preferably a metal such as titanium or tantalum, or alloys thereof which is coated with an oxide of a platinum group metal selected from the group consisting of ruthenium, rhodium, platinum, palladium, osmium, iridium, and mixtures thereof. Most preferably the coating comprises of ruthenium oxide. Generally the coating thickness is about 0.01 to 0.05 mm. However, a ceramic or a metal insert alone can be used provided it has a lower overvoltage than the metal piping being protected.

While the present invention has been described hereinabove with reference to the specific embodiments shown in the drawings, it should be understood that various changes and modifications are possible without departing from the scope and spirit of the invention. For example, the specific structures of the invention as described hereinabove need not to be employed in all of the supply and discharge pipes in the electrolytic cell of this invention, and if desired, such structures may be employed only in some of the supply and discharge pipes. Such an embodiment is also within the scope of the invention.

Furthermore, it will be obvious to those skilled in the art that the cation exchange membranes and other constituent elements of the bipolar or monopolar electrolytic cell of the invention and the method of its operation may be those known heretofore in the art.

What is claimed is:

1. In an electrolyzer system having metallic supply and discharge piping subjected to shunt currents, the improvement which comprises a removable target electrode in the section of said piping subjected to said shunt currents, said target electrode having a lower overvoltage than the metallic piping being protected and comprising a valve metal having a ruthenium oxide coating.

2. The electrolyzer system of claim 1 wherein said target electrode comprises an electrically conductive plastic, metal, ceramic or a mixture thereof.

3. The electrolyzer system of claim 1 wherein said platinum group metal is selected from the group consisting of ruthenium, rhodium, platinum, palladium osmium, iridium and mixtures thereof.

4. The electrolyzer system of claim 1 wherein said valve metal is selected from the group consisting of titanium and tantalum.

5. The electrolyzer system of claim 1 comprising a bipolar electrolyzer.

6. The electrolyzer system of claim 1 wherein said target electrode comprises a ceramic.

7. The electrolyzer system of claim 6 wherein said target electrode is in the juncture of a titanium metal piping and a polymeric piping.

8. In an electrolyzer system having metallic supply and discharge piping subjected to shunt currents, the improvement which comprises a target electrode frictionally held in the section of said piping subjected to said shunt currents, said target electrode comprising a removable member consisting of a metal substrate having a ruthenium oxide coating, whereby said target electrode reduces corrosion resulting from shunt currents.

9. The electrolyzer system of claim 8 wherein said platinum group metal is selected from the group consisting of ruthenium, rhodium, platinum, palladium, osmium, iridium and mixtures thereof.

10. The electrolyzer system of claim 8 wherein said metal is selected from the group consisting of stainless steel, titanium and tantalum.

11. The electrolyzer system of claim 8 wherein said target electrode comprises a ruthenium and titanium oxide coated titanium.

12. The electrolyzer system of claim 8 wherein said target electrode comprises a split sleeve.

13. The electrolyzer system of claim 8 comprising a bipolar electrolyzer.

14. The electrolyzer system of claim 13 wherein said system comprises titanium metal piping components and electrically non-conductive polymeric piping components.

15. The electrolyzer system of claim 14 wherein said target electrode is in the juncture of said titanium metal piping and polymeric piping.

16. The electrolyzer system of claim 15 wherein said polymeric piping comprises polytetrafluoroethylene.

17. The electrolyzer system of claim 8 wherein said target electrode is a separate component from the piping.

18. The electrolyzer system of claim 8 wherein said metal has a lower overvoltage than titanium.

19. In an electrolyzer system having metallic supply and discharge piping subjected to shunt currents, the improvement which comprises a cylindrically shaped removable target electrode frictionally held in the section of said piping subjected to said shunt currents and conductively attached to said piping, said target electrode having a conductive coating and a lower overvoltage than the metallic piping being protected.

* * * * *